US007367134B2

(12) United States Patent
Osvatic et al.

(10) Patent No.: US 7,367,134 B2
(45) Date of Patent: May 6, 2008

(54) DISHWASHER VENT ASSEMBLY

(75) Inventors: Michael S. Osvatic, Waukesha, WI (US); Michael K. Hintz, Waukesha, WI (US); Joel C. Bragg, Waterford, WI (US); Jeffrey J. Krieger, Mukwonago, WI (US); Mark D. Rodaer, Wauwatosa, WI (US)

(73) Assignee: Illinois Tool Works, Inc., Glenview, IL (US)

( * ) Notice: Subject to any disclaimer, the term of this patent is extended or adjusted under 35 U.S.C. 154(b) by 98 days.

(21) Appl. No.: 11/152,693

(22) Filed: Jun. 14, 2005

(65) Prior Publication Data

US 2005/0274036 A1 Dec. 15, 2005

Related U.S. Application Data

(60) Provisional application No. 60/579,883, filed on Jun. 15, 2004.

(51) Int. Cl.
*F26B 19/00* (2006.01)

(52) U.S. Cl. ..... 34/62; 34/84; 34/595; 137/514; 335/31; 188/38

(58) Field of Classification Search ..... 34/62, 34/68, 79, 84, 595; 137/514; 188/38; 335/31
See application file for complete search history.

(56) References Cited

U.S. PATENT DOCUMENTS

| | | | | |
|---|---|---|---|---|
| 3,876,469 | A * | 4/1975 | Schimke | 134/95.2 |
| 4,754,770 | A * | 7/1988 | Fornasari | 134/57 D |
| 5,660,195 | A * | 8/1997 | Taylor et al. | 134/58 D |
| 5,836,324 | A * | 11/1998 | Johnson et al. | 134/58 D |
| 6,293,289 | B1 | 9/2001 | Hapke et al. | |
| 6,718,838 | B2 * | 4/2004 | Joyce et al. | 74/107 |
| 2004/0080219 | A1 * | 4/2004 | Cerruti | 310/62 |
| 2006/0090778 | A1 * | 5/2006 | Oakes et al. | 135/56 D |

* cited by examiner

*Primary Examiner*—S. Gravini
(74) *Attorney, Agent, or Firm*—Boyle Fredrickson, S.C.

(57) ABSTRACT

A mechanized vent for a dishwasher employs a vent plate moving about a hinge axis as driven by a cam mechanism at a surface of the vent plate removed from the hinge axis.

16 Claims, 4 Drawing Sheets

FIG. 3
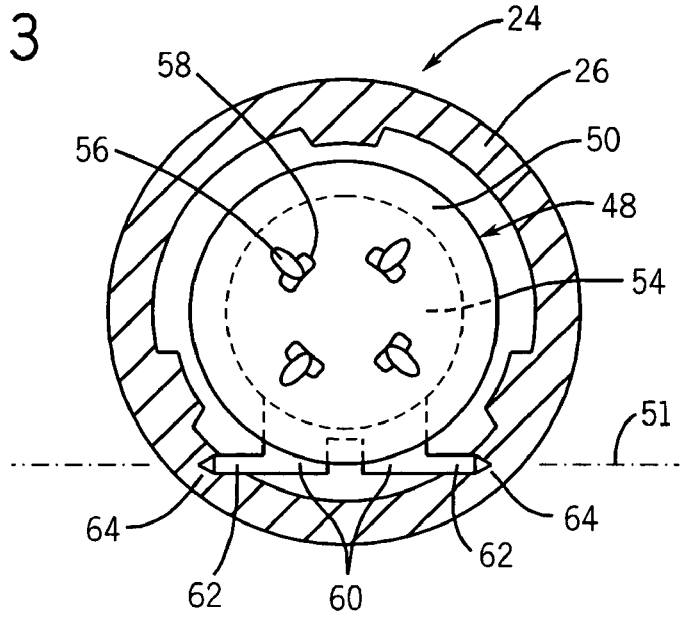
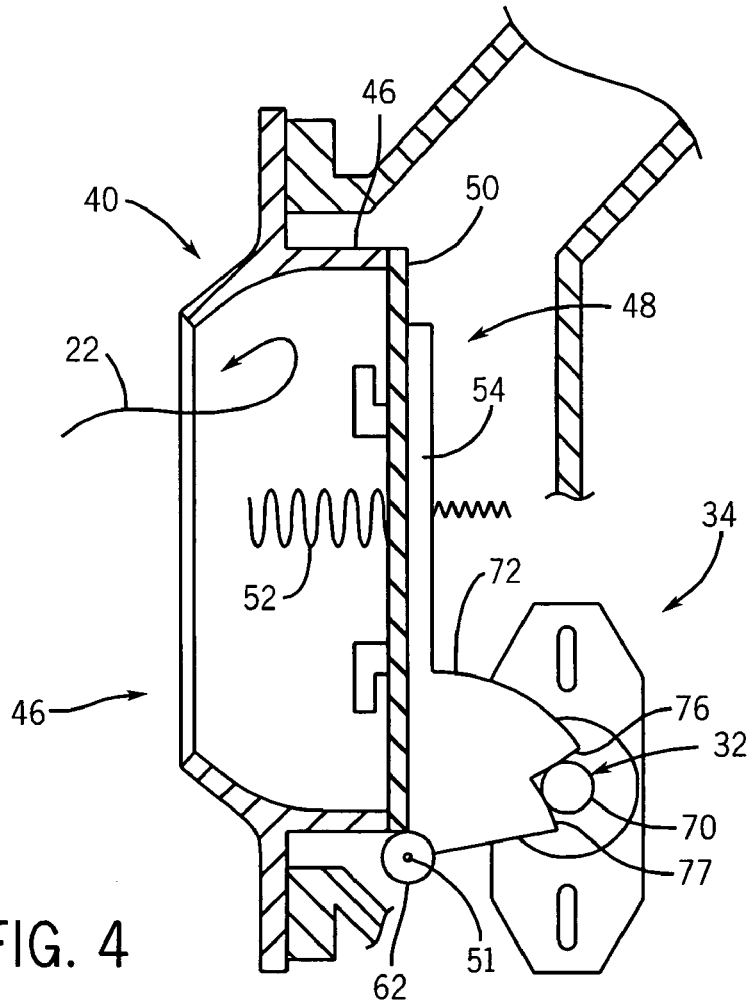
FIG. 4

FIG. 5
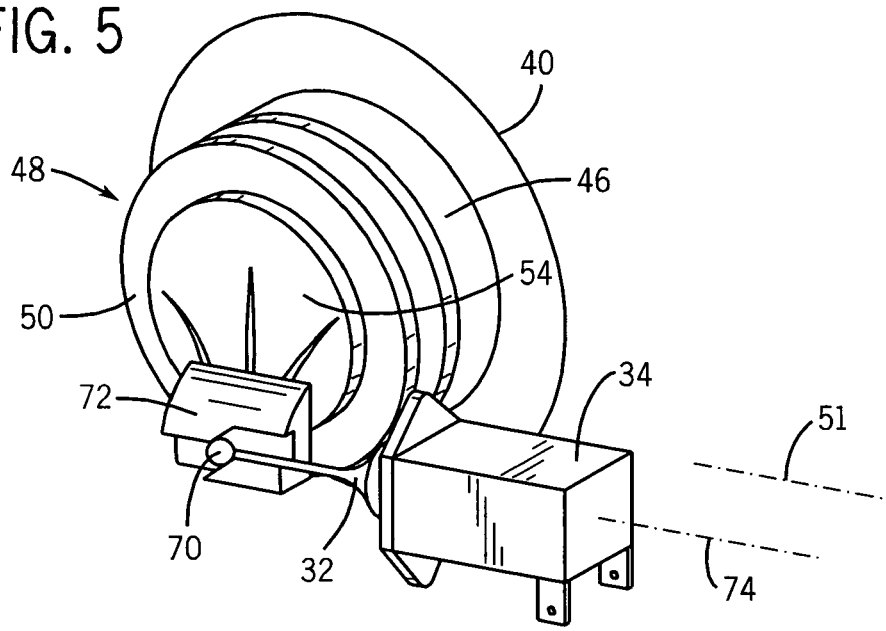
FIG. 6a
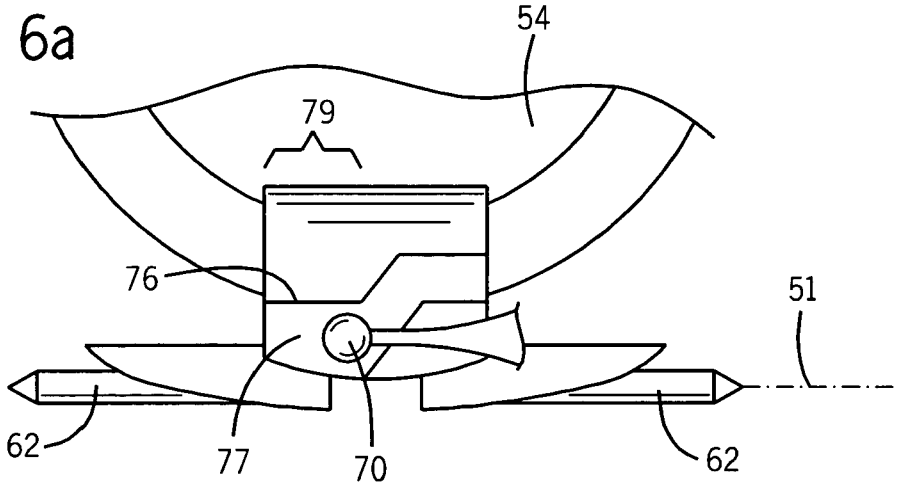
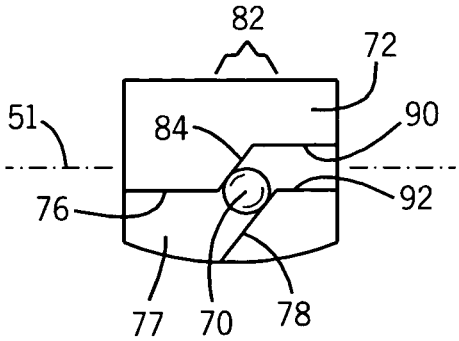
FIG. 6b
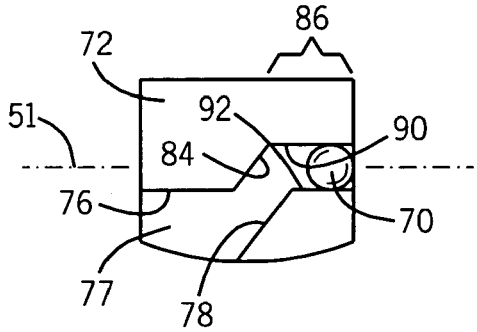
FIG. 6c

DISHWASHER VENT ASSEMBLY

CROSS-REFERENCE TO RELATED APPLICATIONS

This application claims the benefit of U.S. Provisional application 60/579,883 filed Jun. 15, 2004, and hereby incorporated by reference.

STATEMENT REGARDING FEDERALLY SPONSORED RESEARCH OR DEVELOPMENT

BACKGROUND OF THE INVENTION

The present invention relates to automatic dishwashing machines (dishwashers) and in particular to a dishwasher vent for use in a low noise dishwasher.

Dishwashers, such as those found in many homes, provide a chamber holding one or more racks into which eating utensils and cookware may be placed for cleaning. The chamber may be closed by a door opening at the front of the chamber to allow loading and unloading of the chamber.

The door is closed during a washing cycle to prevent the escape of water sprayed within the volume of the chamber to wash items placed in the rack. Upon completion of the washing cycle, a drying cycle is initiated during which water is drained from the chamber and moist air is discharged through a vent. Cool air pulled into the chamber through a lower vent rapidly dries the heated dishes.

Dishwashers can be loud, particularly during the washing cycle, with noise coming from the agitated water, movement of the dishes, and the dishwasher mechanism of pump and motor. Some of this noise can be reduced by properly shrouding the washing chamber with acoustically absorbent material, nevertheless, even with a properly shrouded chamber, a substantial amount of noise can escape through the vent by diffraction.

One method of reducing vent-transmitted noise is by offsetting the inlet and outlet of the vent to provide a baffling that prevents direct passage of sound through the vent opening. This approach can also prevent water from passing through the vent.

A second method of reducing vent-transmitted noise is to close the vent with a valve plate or similar mechanism during the washing cycle and open the vent only during the drying cycle. A vent suitable for this purpose is described in U.S. Pat. No. 6,293,289 filed Nov. 8, 1999, assigned to the assignee of the present invention, and hereby incorporated by reference. This patent describes, in one embodiment, a wax motor operating a hinged valve plate that opens and closes to control air and sound flow through the vent. The hinged plate may also be independently opened by excess pressure in the washing machine so as to accommodate "surge pressures" resulting, for example, from pressure build up caused by an opening and closing of the dishwasher in mid-cycle where introduced cold air is rapidly heated by dishes and hot water when the door is resealed.

Superior drying requires that the vent area be made as large as possible when the vent is open and that the valve plate provide minimal obstruction to the flowing air. This may be done by placing the hinge axis of the valve plate generally parallel to the front and rear surfaces so that the valve plate opens to align with the natural flow lines of air.

The actuator for a valve plate in a vent may be positioned outside of the vent housing (defining the vent passage) to improve airflow and to protect the actuator from water. This may be accomplished by extending the shaft about which the vent plate rotates out of the vent housing through a journal hole in one wall of the vent to be engaged by an actuator. The journal hole is kept small to prevent the escape of water from the vent and may include a seal.

Mechanically, passing the shaft through a wall of the vent housing requires either that the vent plate be detachable from the shaft, so that the shaft may be inserted through a journal hole into the housing without obstruction, or that the housing be separable into two halves to allow an integral vent plate/shaft assembly to be positioned in the vent body and the housing closed over that. Both of these approaches increase the complexity of manufacturing the vent: the former requiring assembly of the shaft and vent plate from inside of the vent, and the latter requiring assembly of the vent housing from several pieces.

BRIEF SUMMARY OF THE INVENTION

The present invention employs a cam drive mechanism moving a valve plate within a dishwasher vent without the need for a direct connection between an actuator and the shaft about which the valve plate rotates. This approach allows the valve plate shaft to be retained wholly within the vent housing eliminating leaks along a rotating shaft passing through the housing or excess shaft friction, and allowing the vent housing to be molded or preassembled as one piece with the valve plate is snapped into place subsequent to the molding.

The drive mechanism allows the axis of the valve plate and the drive actuator (preferably a wax motor) to be parallel and closely adjacent to the valve plate pivot axis, providing an extremely compact mechanism that may fit easily between the front and rear panel of a dishwasher door. This advantage also applies to an embodiment in which the valve plate is supported by externally inserted pins or the like.

In one embodiment, the cam mechanism may open and close the valve plate without the need for a biasing spring element or reliance on gravity, and may accommodate over travel common in wax motors while still providing a large amount of mechanical amplification to fully open and close the valve plate with small amounts of actuator travel.

In one embodiment, the operator may extend along an axis parallel to, but displaced from, a pivot axis of the valve plate to provide an extremely compact assembly.

In one embodiment, a spring biases the valve plate to allow the valve plate to open independently of the wax motor to relieve surge pressures.

In one embodiment, an elastomeric seal is held in cantilevered fashion at the valve seat to provide a compliant seal blocking sound transmission.

These particular objects and advantages may apply to only some embodiments falling within the claims and thus do not define the scope of the invention.

BRIEF DESCRIPTION OF THE DRAWINGS

FIG. 3 is a cross-sectional view of the inlet port of the vent of FIG. 2 taken along lines 3-3 showing a snap-in engagement of an integrated vent plate and shaft at the inlet port;

FIG. 4 is a cross-sectional view taken along lines 4-4 of FIG. 3 showing the vent plate in a closed configuration for blocking sound and the flow of air;

FIG. 5 is a perspective view of the engagement between a wax motor actuator and a cam surface on the vent plate of FIG. 4 as viewed from inside the vent housing;

FIGS. 6*a* through 6*c* are rear elevational views of the cam surface with the vent plate in three states of closed, transition, and open;

DETAILED DESCRIPTION OF THE PREFERRED EMBODIMENT

Figure 1:
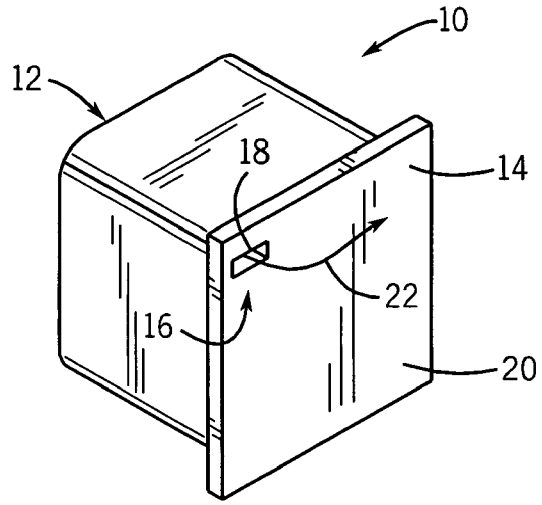
FIG. 1 is a simplified view of a dishwasher in perspective showing location of a door vent for venting moist air.

Referring now to FIG. 1, a dishwasher 10 may include a housing 12 holding a washing chamber and a front door 14 that may be opened to obtain access to the washing chamber for loading and unloading of dishes. A door vent 16 provides an outlet port 18 in the front surface 20 of the door 14 to allow for the escape of moist air 22.

Figure 2:
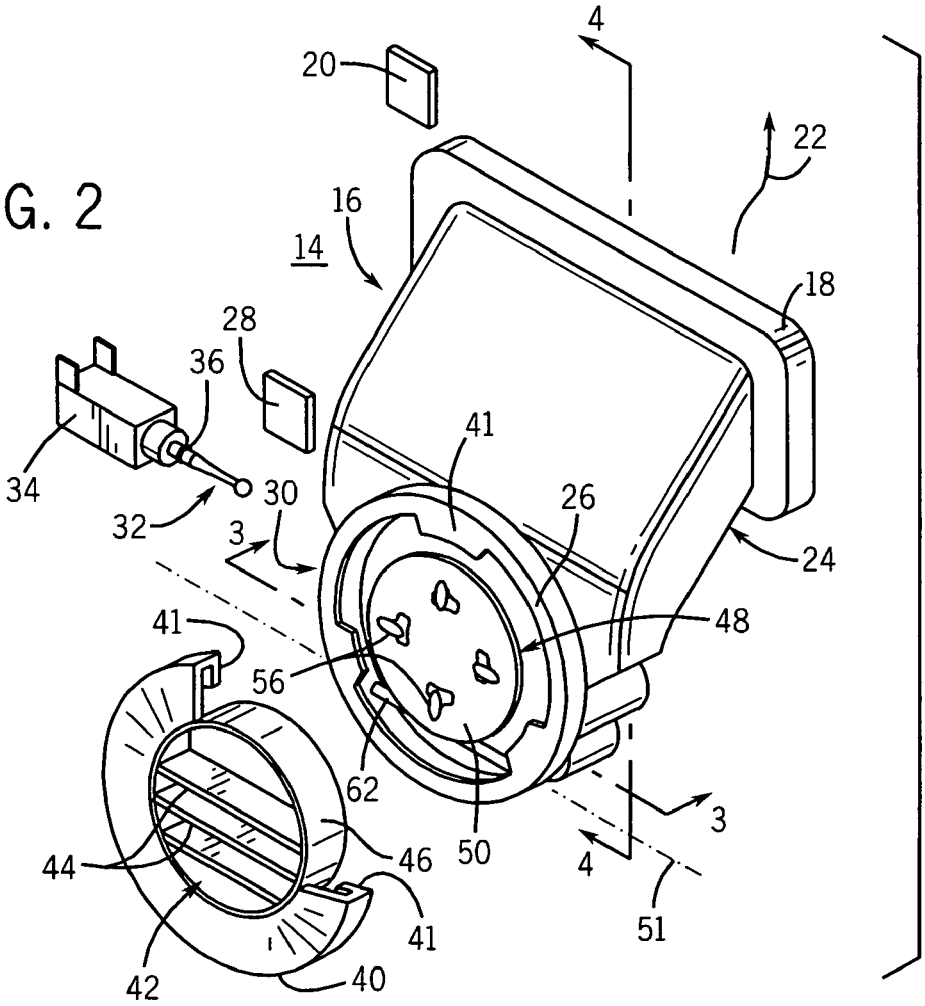
FIG. 2 is an exploded perspective view of the door vent of FIG. 1 as viewed from the inside of the dishwasher and as may be positioned between the front and rear door surfaces.

Referring now to FIG. 2, a vent housing 24 provides an air passage between the outlet port 18 on the front surface 20 and an inlet port 26 opening at the rear surface 28 of the door 14 facing the washing chamber. The outlet port 18 is positioned higher on the door than the inlet port 26, both to provide a serpentine path for muting sound passing through the vent housing 24 and to cause water splashed into and condensation forming within the vent housing to drain downward out of inlet port 26 back into the wash chamber. Preferably, the vent housing 24 is manufactured as a single injection molded part avoiding a need for subsequent assembly of multiple components using screws or welds and eliminating the need to test for leakage of the seams or to provide expensive gasketing at the seams.

The air passage of the vent housing 24 is substantially continuous to prevent leakage of water into the door 14, with the exception of a bore 30 opening between inlet port 26 and outlet port 18, generally perpendicular to the airflow. The bore 30 may be created during the molding of the vent housing 24 using an injection mold with a removable core pin as is understood in the art.

The bore 30 allows an operator 32 of a wax motor 34 (the wax motor 34 positioned outside the vent housing 24) to enter the air passage. The operator 32 of the wax motor 34 has an o-ring seal 36 allowing movement of the operator within the bore 30 without the leakage of liquid there through as will be described below.

Referring still to FIG. 2, the inlet port 26 is covered at the rear surface 28 of the door 14 by a removable vent cap 40 that attaches to the vent housing 24 by a twist lock formed from a set of interengaging tabs 41 molded into both the vent cap 40 and the inlet port 26. The vent cap 40 provides an aperture 42 aligning with the opening of the inlet port 26 and the aperture 42 is covered by a grating 44 so as to deflect water and food particles away from the passageway of the vent housing 24.

The vent cap 40 also provides a rear facing valve seat ring 46 extending into the inlet port 26. This valve seat ring 46 cooperates with a valve plate 48 removably attached within the inlet port 26 to hinge about a hinge axis 51. The hinge axis 51 is located beneath the valve plate 48 in a horizontal plane and is parallel to the front surface 20 and rear surface 28.

When the valve plate 48 is in a closed position as shown in FIG. 4, a rubber disk 50 forming the inner surface of the valve plate 48 abuts the edge of the valve seat ring 46 blocking the flow of moist air 22 into the vent passageway and providing a barrier against sound 52. The rubber disk 50 is supported from front and its side removed from the vent cap 40 by a support disk 54 of slightly smaller diameter than the rubber disk 50 so that the peripheral edge of the rubber disk 50 extends in cantilevered fashion from the peripheral edge of the support disk 54 so as to flex to accommodate slight irregularities in the valve seat ring 46 of the vent cap 40.

Referring now to FIG. 3, the support disk 54 of the valve plate 48 includes four hooked tabs 56 extending through corresponding holes in the rubber disk 50. The rubber disk 50 may be stretched to fit over the hooked tabs and thereby retained against the support disk 54 by the hooks on the hooked tabs 56. Sizes of the openings 58 in the rubber disk 50 are relatively small being typically substantially less than 1/10th the total area of the rubber disk 50. Accordingly, as shown in FIG. 4, the rubber disk 50 covers the majority and the center of the support disk 54 providing improved sound absorption when the valve plate 48 is closed in comparison to systems which use an annular rubber gasket. Using a substantially continuous rubber disk 50 also provides a cost savings by eliminating the need for a thicker support disk 54 for sound absorption and by making use of the center portions of the rubber disk 50 that might otherwise be removed and discarded in the fabrication of a washer shape.

Referring now to FIGS. 2 and 3, the support disk 54 has downwardly extending legs 60 supporting horizontal and opposed outwardly extending pivot pins 62 defining the hinge axis 51 described above. The support disk 54, the leg 60, and the pins 62 may be constructed of a material, such as injection moldable thermoplastic, providing sufficient flexibility so that the legs 60 may be compressed inward in order for the pins 62 to snap into corresponding pivot sockets 64 molded in the interior of the housing 24 adjacent to the inlet port 26. The sockets 64 are blind, that is, they do not lead from the inside of the vent housing 24 to the outside of the vent housing 24, and therefore the sockets 64 provide no passage for water or moisture splashing into the vent housing 24 to leak into the door 14. Eliminating the need for the shaft supporting the valve plate 48 to pass wholly through the vent housing 24 simplifies single piece injection molding of the vent housing 24, improves the integrity of the vent housing 24, and reduces resistance of valve plate 48 to movement about the hinge axis 51 by allowing a small contact area between the pins 62 and sockets 64.

The present invention also contemplates an alternate embodiment in which one or more metal pins (not shown) may be pressed into through holes aligned with but replacing the sockets 64 and serving as an axle for the valve plate 48. As before, the advantages of being able to produce a single piece molding of the vent housing 24, of limiting the path of water leakage, and of avoiding the excess resistance of a rotating drive shaft may be obtained.

Referring now to FIGS. 4 and 5, actuation of the valve plate 48 is accomplished without external access to a supporting shaft of the valve plate 48 by a cam drive mechanism. As mentioned above, the operator 32 of the wax motor 34 may extend into the vent housing 24 through bore 30. The end of the operator 32 has a ball tip 70 that engages a cam 72 extending from the side of the support disk 54 removed from the vent cap 40. The cam 72 provides actuation surfaces that form a Z-shaped channel capturing the ball tip 70 and thus allowing opening and closing of the valve plate 48 with extension and retraction of the operator 32 by the wax motor 34. The ball tip 70 may include a hook (not shown) to provide improved engagement with the cam 72 as will be understood to those of ordinary skill in the art.

Generally, the extension axis 74 of the operator 32 is parallel to the hinge axis 51 with the ball tip 70 of the operator 32 positioned closely to the hinge axis 51. This produces an extremely compact mechanism and one that is desirably sensitive to small motions of the operator 32. Yet the range of travel of the operator 32 of a wax motor 34 can vary over time, so capture of the ball tip 70 by the cam 72 requires an accommodation of assembly tolerance and over travel of the operator 32.

Referring now to FIG. 6, this accommodation is provided by creating over travel and under travel portions of the cam 72. When the ball tip 70 is in its further extent from the wax motor (to the left in FIG. 6*a*), it is in the over travel position 79 and contacts cam surface 76 which extend generally horizontally so that further travel of the ball tip 70 does not provide further torsion or twisting of the valve plate 48 about the hinge axis 51. In this over travel position 79, the valve plate 48 is closed against the valve seat ring 46 as shown in FIG. 4. Surface 77 may lie on a radius about axis 51 to allow free rotation of valve plate 48 in a closing direction without interference between the ball tip 70 and surface 77, reflecting the constant radial distance between ball tip 70 and axis 51. Ultimately, closing of the valve plate 48 is limited by the engagement of the valve plate 48 and the valve seat ring 46.

When the ball tip 70 is retracted somewhat, it moves to an actuation position 82 as shown in FIG. 6*b*, the ball tip 70 now held captive between upper surface 84 and lower cam surface 78 diagonal to the hinge axis 51 and causing an opening or closing of the valve plate 48 with retraction or extension of the ball tip 70. This actuation position 82 may be relatively short and may be fit easily within the assured operating range of the wax motor 34 during its lifetime or caused by unit-to-unit variation.

As shown in FIG. 6*c*, when the ball tip 70 is closest to the wax motor 34, for example, prior to closure of the valve plate 48 or after opening of the valve plate 48, it is held captive between surfaces 90 and 92 on its top and bottom sides in an under travel position 86. The surfaces 90 and 92 are essentially horizontal so that the ball tip 70 may be threaded into engagement with the cam 72 when the wax motor 34 is installed on the housing 24. Thus, over travel and under travel may be accommodated while maintaining a close coupling between the ball tip 70 and the cam 72.

Figure 7:
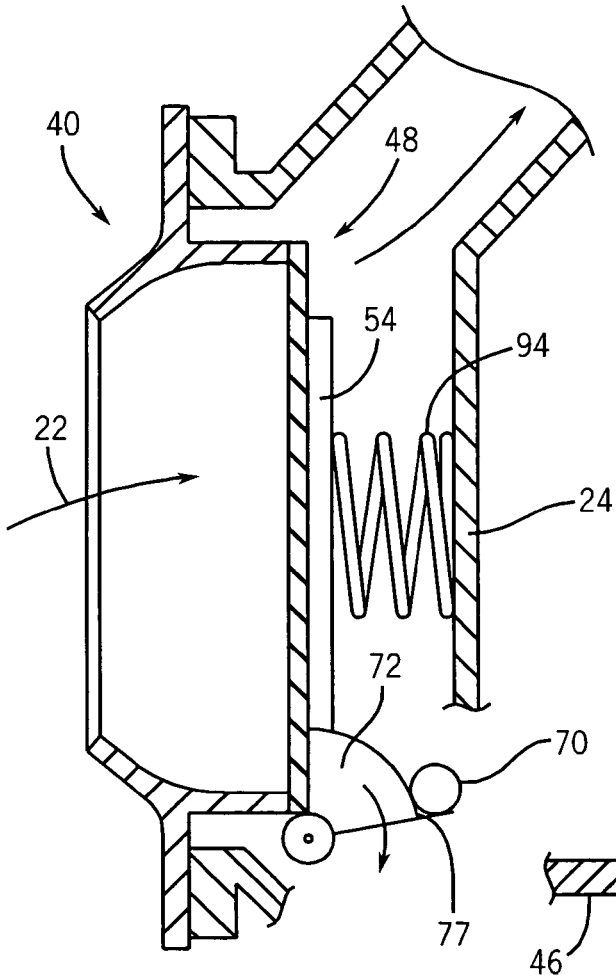
FIG. 7 is a figure similar to that of FIG. 4 showing an alternative embodiment of the door vent in which the valve plate may move independently in response to surge pressures.

Referring now to FIG. 7, in a second embodiment, the cam 72 may be modified to remove the surfaces 76, 84, and 90 shown in FIGS. 6*a*, 6*b*, and 6*c*. As described above, these surfaces are used to allow extension of the ball tip 70 to close the valve plate 48. Surfaces 78 and 92 which allow the ball tip 70 to open the valve plate 48, remain in place. As a result, the entire surface of the cam 72 above surfaces 78 and 92 is lies on a constant radius about axis 51 to allow free rotation of valve plate 48 in a closing direction without interference between the ball tip 70 and surface 77

Closing of the valve plate 48 is performed in this embodiment by a helical compression spring 94 placed between the rear surface of the support disk 54 and a front surface of the rear wall of the housing 24. Normally this spring 94 causes the valve plate 48 to close against the valve seat ring 46 absent contact between the ball tip 70 and the cam surfaces 78 or 92. Moist air 22 of a predetermined pressure (for example, one half inch of water) as selected by varying the force of the spring 94 and the area of the valve plate 48, will allow the valve plate 48 to swing open independent of the position of the ball tip 70 to relieve surge pressures as required.

In the absence of surge pressure, the valve plate 48 may be opened by the ball tip 70 interacting with cam surfaces 78 and 92 as described above. Other methods of biasing the valve plate 48 closed including gravity or other types of springs may also be employed as will be understood to those of ordinary skill in the art.

Figure 8:
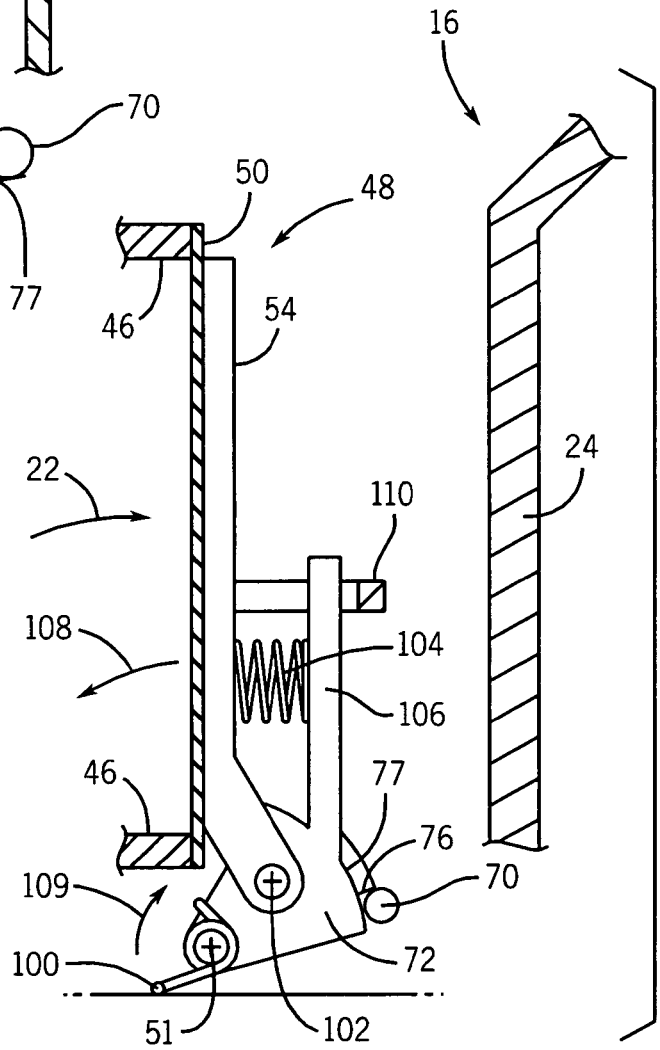
FIG. 8 is a figure similar to FIG. 7 showing an alternative embodiment in which the valve plate has a default open position if the wax motor is removed.

Referring now to FIG. 8, an alternative embodiment of the door vent 16 provides both the surge pressure release, described above, and a default open position for the valve plate 48. This default to an open position allows air to pass through the door vent 16 should the wax motor 34 (described above) be removed or the ball tip 70 and/or its connecting shaft be broken or damaged in such a way as to disengage from the cam 72. In this way, the risk of suffocation to a child entrapped in a dishwasher that has been abandoned or partially disassembled is reduced.

In contrast to the embodiment shown in FIG. 7 in which compression spring 94 is used to close the valve plate 48, in the embodiment of FIG. 8, a torsion spring 100 is placed about pivot axis 51 so as to provide a clockwise bias 109 to the cam 72 about the hinge axis 51. The bias provided by torsion spring 100 opens the valve plate 48 absent countervailing force by the ball tip 70 on the cam surface 76 (also shown in FIGS. 6*a-c*).

In this embodiment, the support disk 54 of the valve plate 48 is not rigidly attached to the cam 72, but may pivot with respect to the cam 72 about a second hinge axis 102 on the cam 72. A helical compression spring 104 fits between the rear surface of the support disk 54 and the front surface of an extension 106 to the cam 72, so that the support disk 54 is biased forward toward the valve seat ring 46 in a counter-clockwise direction 108 about hinge axis 102.

Movement of the support disk 54 in the counter-clockwise direction 108 is limited by a stop 110 extending rearward from the support disk 54 to oppose a rear surface of the upward extension 106, allowing only limited relative travel between the support disk 54 and the cam 72 in a counter-clockwise direction 108.

It will be understood from this description, that removal of the ball tip 70 will cause the cam 72 to move in a clockwise direction under the bias of the torsion spring 100. This will cause valve plate 48 to open after its forward travel in a counter-clockwise direction 108 under the urging of spring 104 and is stopped by stop 110.

Conversely in normal operation, when the ball tip 70 is fully extended from the wax motor 34, the cam 72 is rotated in a counter-clockwise direction pressing the valve plate 48 and the rubber disk 50 against the valve seat ring 46 to close the vent. The helical compression spring 104 allows some over-travel of the cam 72 with no adverse effect.

In this position, a surge pressure of moist air 22 can nevertheless push against the valve plate 48 causing clockwise rotation against the spring 104 as described previously to open the valve plate 48 without movement of the cam 72.

It is specifically intended that the present invention not be limited to the embodiments and illustrations contained herein, but include modified forms of those embodiments including portions of the embodiments and combinations of elements of different embodiments as come within the scope of the following claims.

We claim:

1. A vent for a dishwasher comprising:

a vent housing providing a conduit having a conduit wall for passage of moist air from the inside the dishwasher to an outlet outside the dishwasher;

a valve plate having rotatable pivot elements allowing pivoting of the valve plate to block and unblock the conduit;

an electrical actuator contacting the valve plate to move the valve plate to block and unblock the conduit; and wherein the electrical actuator is a linear actuator providing an operator moving along a line and contacting a cam surface on the valve plate to pivot the valve plate with movement of the operator along the cam surface;

wherein the line along which the operator moves is substantially perpendicular to motion of the valve plate as it blocks and unblocks the conduit with pivoting.

2. The vent of claim 1 wherein the vent housing is injection molded as one piece.

3. The vent of claim 1 wherein the valve plate has two arms each with pins extending oppositely along a pivot axis to provide the rotatable pivot elements, the arms flexing toward each other to allow the pins to snap engage with holes in the vent housing.

4. The vent of claim 3 wherein the holes are blind holes which do not provide a path from inside the conduit to outside the conduit.

5. The vent of claim 1 wherein the electrical actuator is a wax motor.

6. The vent of claim 1 wherein the operator extends along an axis parallel to, but displaced from, a pivot axis of the valve plate.

7. The vent of claim 1 wherein the cam surface includes an actuation portion causing movement of the valve plate when the actuation portion is traversed by the operator and an over travel portion not causing movement of the valve plate when the over travel portion is traversed;

whereby over travel of the linear actuator maybe accommodated.

8. The vent of claim 7 wherein the cam surface further includes an under travel portion opposite the over travel portion with respect to the actuation portion, the under travel portion not causing movement of the valve plate when the under travel portion is traversed;

whereby under travel of the linear actuator may be accommodated.

9. The vent of claim 1 wherein the cam surface captures the operator to allow the operator to open and close the valve plate with movement in two different directions.

10. The vent of claim 9 including a hinge element between the valve plate and the cam surface to allow both movement of the operator and a predetermined pressure of moist air from the dishwasher to open the valve plate independently.

11. The vent of claim 10 including a spring biasing the valve plate open in an absence of contact between the operator and the cam surface.

12. The vent of claim 1 wherein the cam surface contacts only one side of the operator to allow both movement of the operator and a predetermined pressure of moist air from the dishwasher to open the valve plate independently.

13. The vent of claim 1 including a spring biasing the valve plate open in an absence of contact between the electrical actuator and the valve plate.

14. The vent of claim 1 including a hinge element between the valve plate and an element on the valve plate contacting the electrical actuator to allow both movement of the electrical actuator and a predetermined pressure of moist air from the dishwasher to open the valve plate independently.

15. A noise-reducing vent for a dishwasher comprising:

a vent housing providing a conduit for a passage of moist air from the dishwasher;

a valve plate within the housing movable under an urging of an electrical actuator toward and away from a valve seat to block and unblock the passage of air through the conduit; and a elastomeric gasket providing a flexible sheet having a center attached to the valve plate at a support area and having a cantilevered sheet edge at its periphery, the sheet edge extending beyond the support area of the valve plate to flex with respect to the support area of the valve plate when the valve plate engages the valve seat with motion of the valve plate, the membrane of the elastomeric gasket being substantially continuous over the valve plate to block sound transmission through the valve plate when the valve plate blocks the passage of air through the conduit with the membrane of the elastomeric gasket sandwiched between the valve plate and the valve seat to seal the conduit so that any sound must travel through the substantially continuous membrane.

16. The noise reducing vent of claim 15 wherein the valve plate has prongs passing though holes in the elastomeric gasket to retain the elastomeric gasket wherein the holes are substantially less than 1/10 an area of the elastomeric gasket.

* * * * *